US009589423B2

(12) United States Patent
Mosley et al.

(10) Patent No.: US 9,589,423 B2
(45) Date of Patent: Mar. 7, 2017

(54) METHOD AND SYSTEM FOR PRE-REVEALED ELECTRONIC SWEEPSTAKES

(71) Applicant: EPIC TECH, LLC, Lavonia, GA (US)

(72) Inventors: Bob Mosley, Piedmont, SC (US); Troy Jungmann, Leander, TX (US)

(73) Assignee: EPIC TECH, LLC, Lavonia, GA (US)

( * ) Notice: Subject to any disclaimer, the term of this patent is extended or adjusted under 35 U.S.C. 154(b) by 197 days.

(21) Appl. No.: 13/915,229

(22) Filed: Jun. 11, 2013

(65) Prior Publication Data

US 2013/0331178 A1 Dec. 12, 2013

Related U.S. Application Data

(60) Provisional application No. 61/658,608, filed on Jun. 12, 2012.

(51) Int. Cl.
*A63F 9/00* (2006.01)
*G07F 17/32* (2006.01)

(52) U.S. Cl.
CPC ..... *G07F 17/329* (2013.01); *G07F 17/3269* (2013.01)

(58) Field of Classification Search
None
See application file for complete search history.

(56) References Cited

U.S. PATENT DOCUMENTS 5,280,909 A 1/1994 Tracy
5,332,228 A 7/1994 Schultz
5,351,970 A 10/1994 Fioretti
5,775,537 A 7/1998 Doyle, Jr.
5,779,546 A 7/1998 Meissner et al.
5,927,714 A 7/1999 Kaplan
6,015,346 A 1/2000 Bennett
6,110,043 A 8/2000 Olsen
6,120,031 A 9/2000 Adams
6,126,542 A 10/2000 Fier
6,146,273 A 11/2000 Olsen
6,224,483 B1 5/2001 Mayeroff
6,264,560 B1 7/2001 Goldberg et al.
6,311,976 B1 11/2001 Yoseloff et al.
6,319,125 B1 11/2001 Acres
6,345,824 B1 2/2002 Selitzky
6,464,581 B1 10/2002 Yoseloff et al.
(Continued)

*Primary Examiner* — Seng H Lim

(74) *Attorney, Agent, or Firm* — Nelson Mullins Riley & Scarborough LLP

(57) ABSTRACT

A system and method that generates a finite number of sweepstakes entries for a sweepstakes, facilitates a selection of one or more sweepstakes entries from the finite number of entries, determines the result of each selected sweepstakes entry, allocates each nonzero result to the user, and provides the user with at least one of the selected sweepstakes entries, the result of each selected sweepstakes entry, the sum of all nonzero results from the selected sweepstakes entries, a code that is associated with the selected sweepstakes entries, and a program that is configured to cause a computer to interactively display to the results associated with the selected sweepstakes entries to the user. The results of the selected sweepstakes entries may be viewed in the form of a simulated game, or the user may log into an account associated with the user to view the total amount won.

21 Claims, 4 Drawing Sheets

(56) References Cited

U.S. PATENT DOCUMENTS 6,475,088 B1 11/2002 Jones et al.
6,676,512 B2 1/2004 Fong et al.
6,755,737 B2 6/2004 Jackson et al.
6,780,109 B2 8/2004 Kaminkow
6,805,349 B2 10/2004 Baerlocher et al.
6,887,154 B1 5/2005 Luciano et al.
6,896,617 B2 5/2005 Daly
6,899,625 B2 5/2005 Luciano, Jr. et al.
6,910,962 B2 6/2005 Marks et al.
6,926,607 B2 8/2005 Slomiany et al.
6,939,228 B2 9/2005 Shimizu
6,988,946 B2 1/2006 Michaelson et al.
7,048,275 B2 5/2006 Adams
7,070,502 B1 7/2006 Bussick et al.
7,077,745 B2 7/2006 Gomez et al.
7,108,602 B2 9/2006 Daly
7,169,041 B2 1/2007 Tessmer et al.
7,226,359 B2 6/2007 Bussick et al.
7,229,350 B2 6/2007 Baerlocher et al.
7,237,775 B2 7/2007 Thomas et al.
7,311,598 B2 12/2007 Kaminkow et al.
7,316,609 B2 1/2008 Dunn et al.
7,371,170 B2 5/2008 Cregan et al.
7,371,173 B2 5/2008 Gatto et al.
7,390,260 B2 6/2008 Englman
7,396,279 B2 7/2008 Berman et al.
7,416,484 B1 8/2008 Nelson et al.
7,419,162 B2 9/2008 Lancaster et al.
7,419,429 B2 9/2008 Taylor
7,481,709 B2 1/2009 Bussick et al.
7,578,735 B2 8/2009 Frizzell et al.
7,585,219 B2 9/2009 Randall et al.
7,618,319 B2 11/2009 Casey et al.
7,628,690 B2 12/2009 Englman et al.
7,674,180 B2 3/2010 Graham et al.
7,690,983 B2 4/2010 Hartl et al.
7,699,696 B2 4/2010 Baerlocher et al.
7,736,223 B2 6/2010 Pace
7,749,066 B2 7/2010 Hartman et al.
7,749,071 B2 7/2010 Marks et al.
7,753,769 B2 7/2010 Gomez et al.
7,775,873 B2 8/2010 Aoki et al.
7,789,743 B2 9/2010 Walker et al.
7,789,744 B2 9/2010 Fiden
7,862,427 B2 1/2011 Nguyen et al.
7,892,085 B2 2/2011 Harris
7,976,381 B2 7/2011 Schugar
8,012,011 B2 9/2011 Baerlocher et al.
8,043,155 B2 10/2011 Singer et al.
8,057,295 B2 11/2011 Vann et al.
8,066,563 B1 11/2011 Schultz et al.
8,070,589 B2 12/2011 Macke et al.
8,075,389 B1 12/2011 Schultz et al.
8,109,823 B2 2/2012 Aoki
8,118,660 B2 2/2012 Pace
8,133,111 B2 3/2012 Thomas
8,137,179 B2 3/2012 Jensen et al.
8,157,630 B2 4/2012 Herrmann et al.
8,182,338 B2 5/2012 Thomas et al.
8,192,272 B2 6/2012 Thomas et al.
8,202,160 B2 6/2012 Englman et al.
8,257,159 B1 9/2012 Friedman et al.
8,262,454 B2 9/2012 Lind et al.
8,282,470 B2 10/2012 Englman et al.
8,298,067 B2 10/2012 Kelly et al.
8,303,391 B2 11/2012 Englman et al.
8,328,621 B2 12/2012 Kim
8,328,626 B2 12/2012 Hornik
8,357,041 B1 1/2013 Saunders
8,360,846 B1 1/2013 Bennett et al.
8,366,535 B2 2/2013 Watkins et al.
8,371,925 B2 2/2013 Bonney et al.
8,371,927 B2 2/2013 Englman
8,371,928 B2 2/2013 Englman et al.
8,376,824 B2 2/2013 Muskin
8,382,570 B2 2/2013 Bennett
8,382,574 B2 2/2013 Marks et al.
8,382,576 B2 2/2013 Nakamura
8,388,435 B2 3/2013 Anderson et al.
8,388,438 B2 3/2013 Englman et al.
8,435,119 B2 5/2013 Hardy et al.
8,439,736 B2 5/2013 Reed et al.
8,469,792 B2 6/2013 Pace
8,480,480 B2 7/2013 Thomas et al.
8,496,525 B2 7/2013 Mosley et al.
8,545,315 B2 10/2013 Mosley et al.
8,545,317 B2 10/2013 Mosley et al.
8,585,493 B2 11/2013 Mosley et al.
2002/0052233 A1 5/2002 Gauselmann
2002/0137562 A1 9/2002 Malone
2002/0183107 A1* 12/2002 Wolfe ..... A63F 3/081 463/17
2003/0013513 A1 1/2003 Rowe
2003/0104853 A1 6/2003 Tessmer et al.
2004/0048650 A1 3/2004 Mierau et al.
2004/0097280 A1 5/2004 Gauselmann
2004/0102236 A1 5/2004 Suda et al.
2004/0127276 A1 7/2004 Moody
2004/0147321 A1 7/2004 Duhamel
2004/0235550 A1* 11/2004 McNally ..... G07F 17/329 463/16
2004/0266534 A1 12/2004 Byng
2005/0059470 A1 3/2005 Cannon
2005/0187014 A1 8/2005 Saffari et al.
2005/0239537 A1 10/2005 Ogiwara
2005/0255905 A1* 11/2005 Duke ..... A63F 3/0605 463/17
2006/0025215 A1 2/2006 Thomas
2006/0046830 A1 3/2006 Webb
2006/0052154 A1 3/2006 Boerner
2006/0121971 A1 6/2006 Slomiany et al.
2006/0154718 A1 7/2006 Willyard et al.
2006/0244211 A1 11/2006 Osawa
2006/0258436 A1 11/2006 McBride
2006/0281525 A1 12/2006 Borissov
2007/0060247 A1 3/2007 Low et al.
2007/0082725 A1 4/2007 Low et al.
2007/0135209 A1* 6/2007 Lind et al. ..... 463/25
2007/0178956 A1* 8/2007 Irwin ..... A63F 3/064 463/17
2007/0213124 A1 9/2007 Walker et al.
2007/0232382 A1 10/2007 Berman
2007/0287523 A1 12/2007 Esses et al.
2008/0004102 A1 1/2008 Kojima
2008/0039197 A1 2/2008 Walker et al.
2008/0161081 A1 7/2008 Berman
2008/0188288 A1 8/2008 Seelig et al.
2008/0207301 A1 8/2008 Yokota et al.
2008/0214294 A1 9/2008 Yoshizawa
2008/0227521 A1 9/2008 Aoki et al.
2008/0254854 A1 10/2008 Slomiany et al.
2008/0274783 A1 11/2008 Walker et al.
2008/0305856 A1 12/2008 Walker et al.
2009/0011833 A1 1/2009 Seelig et al.
2009/0017906 A1 1/2009 Jackson
2009/0075720 A1 3/2009 Mathis
2009/0104991 A1 4/2009 Seelig et al.
2009/0111572 A1 4/2009 Bigelow et al.
2009/0117984 A1 5/2009 Seelig et al.
2009/0124347 A1 5/2009 Rodgers et al.
2009/0124371 A1 5/2009 Gilmore et al.
2009/0131158 A1 5/2009 Brunet de Courssou et al.
2009/0137305 A1 5/2009 Luciano et al.
2009/0137313 A1 5/2009 Young
2009/0221353 A1 9/2009 Joung
2009/0239622 A1 9/2009 Fujimori et al.
2009/0239625 A1 9/2009 Yoshizawa
2009/0247255 A1* 10/2009 Batoff ..... G06Q 50/34 463/17
2009/0275375 A1 11/2009 Acres
2009/0312082 A1 12/2009 Hsu
2009/0318231 A1 12/2009 Lange
2009/0325681 A1 12/2009 Englman et al.
2010/0062820 A1 3/2010 Yoshizawa

(56) References Cited

U.S. PATENT DOCUMENTS

| | | | | |
|---|---|---|---|---|
| 2010/0075736 | A1 | 3/2010 | Muir et al. | |
| 2010/0120492 | A1 | 5/2010 | Davis et al. | |
| 2010/0120494 | A1 | 5/2010 | DeWaal et al. | |
| 2010/0120507 | A1 | 5/2010 | Rodgers et al. | |
| 2010/0124988 | A1 | 5/2010 | Amos et al. | |
| 2010/0173690 | A1 | 7/2010 | Jackson | |
| 2010/0285860 | A1 | 11/2010 | Svanas | |
| 2010/0298042 | A1 | 11/2010 | Berman et al. | |
| 2011/0065492 | A1 | 3/2011 | Acres | |
| 2011/0118002 | A1 | 5/2011 | Aoki | |
| 2011/0136561 | A1 | 6/2011 | Acres | |
| 2011/0153446 | A1 | 6/2011 | Werner et al. | |
| 2011/0218028 | A1 | 9/2011 | Acres | |
| 2011/0319153 | A1 | 12/2011 | Gomez et al. | |
| 2012/0034965 | A1 | 2/2012 | Masen et al. | |
| 2012/0034968 | A1 | 2/2012 | Watkins et al. | |
| 2012/0064961 | A1 | 3/2012 | Vancura | |
| 2012/0077569 | A1 | 3/2012 | Watkins et al. | |
| 2012/0077579 | A1 | 3/2012 | Apirian et al. | |
| 2012/0077587 | A1 | 3/2012 | Apirian et al. | |
| 2012/0077588 | A1 | 3/2012 | Apirian et al. | |
| 2012/0078745 | A1 | 3/2012 | Han et al. | |
| 2012/0088567 | A1 | 4/2012 | Aoki et al. | |
| 2012/0214600 | A1 | 8/2012 | Mosley | |
| 2012/0244927 | A1 | 9/2012 | Weatherby et al. | |
| 2012/0289307 | A1 | 11/2012 | Joung | |
| 2012/0295688 | A1 | 11/2012 | Watkins et al. | |
| 2012/0322532 | A1 | 12/2012 | Nauman | |
| 2012/0322563 | A1 | 12/2012 | Nguyen et al. | |
| 2012/0329546 | A1 | 12/2012 | Roukis | |
| 2013/0012307 | A1* | 1/2013 | Mosley et al. | 463/28 |
| 2013/0116042 | A1* | 5/2013 | Mosley et al. | 463/26 |
| 2013/0138490 | A1* | 5/2013 | Mosley et al. | 705/14.14 |
| 2013/0331178 | A1 | 12/2013 | Mosley et al. | |
| 2013/0344948 | A1 | 12/2013 | Mosley et al. | |

* cited by examiner

METHOD AND SYSTEM FOR PRE-REVEALED ELECTRONIC SWEEPSTAKES

PRIORITY CLAIM

This application claims priority to U.S. Provisional Patent Application No. 61/658,608, filed on Jun. 12, 2012, entitled "Method and Systems for Pre-Revealed Electronic Sweepstakes", which is incorporated in its entirety herein.

FIELD OF THE

The present invention relates generally to an electronic sweepstakes system and method.

SUMMARY OF THE INVENTION

A computer implemented method of playing a sweepstakes game comprises at least partially in response to a request from a user to purchase a product, facilitating a selection of a first plurality of sweepstakes tickets from a second finite plurality of sweepstakes tickets that is associated with a sweepstakes. The selection may be wholly based on the purchase of a product, may be given away freely, or the selection may be based on one or more of the purchase of a product, the user's prior purchase history, the amount of the purchase, the cumulative value of the current and prior purchases, or any other criterion that may be used to trigger the selection of sweepstakes tickets.

Once the selection of sweepstakes tickets is completed, the system determines a result associated with each one of the selected sweepstakes tickets. That is, the system reveals the sweepstakes result associated with each of the selected sweepstakes tickets and stores the information in a database. The system then allocates each nonzero result associated with a selected sweepstakes ticket to the user's account. The system then provides the user with at least one of (1) the selection of the first plurality of sweepstakes tickets, (2) the results of each one of the first plurality of sweepstakes tickets, (3) the sum of all results from the first plurality of sweepstakes tickets, (4) a code that is associated with the first plurality of sweepstakes tickets, and (5) a program that is configured to interactively display to the user the results of the sweepstakes tickets. In various embodiments, the system generates the second plurality of sweepstakes tickets prior to the start of the sweepstakes. In some embodiments, the system displays the result for each one of the selected sweepstakes tickets at least partially in response to receiving the code. The system may also display the result for each sweepstakes tickets in response to receiving a display request (e.g., pressing a play button, pulling a handle, etc.).

In various embodiments, the step of allocating the sweepstakes results further comprises provisionally allocating each nonzero result associated with the selected sweepstakes tickets to the user's account. In some of these embodiments, the system may (1) release the provisionally allocated nonzero result for a particular sweepstakes ticket if the user satisfies a first criterion, or (2) discard the provisionally allocated nonzero result for the particular sweepstakes ticket.

In yet other embodiments, the step of providing the user with the sweepstakes tickets results further comprises at least one of (1) storing the selection of the first plurality of sweepstakes tickets on a handheld storage device, (2) storing the results of each one of the first plurality of sweepstakes tickets on a handheld storage device, (3) storing the sum of all results from the first plurality of sweepstakes tickets on a handheld storage device, (4) printing the code associated with the first plurality of sweepstakes tickets, and (5) storing the program on a handheld storage device. In some embodiments, the handheld storage device is flash memory.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
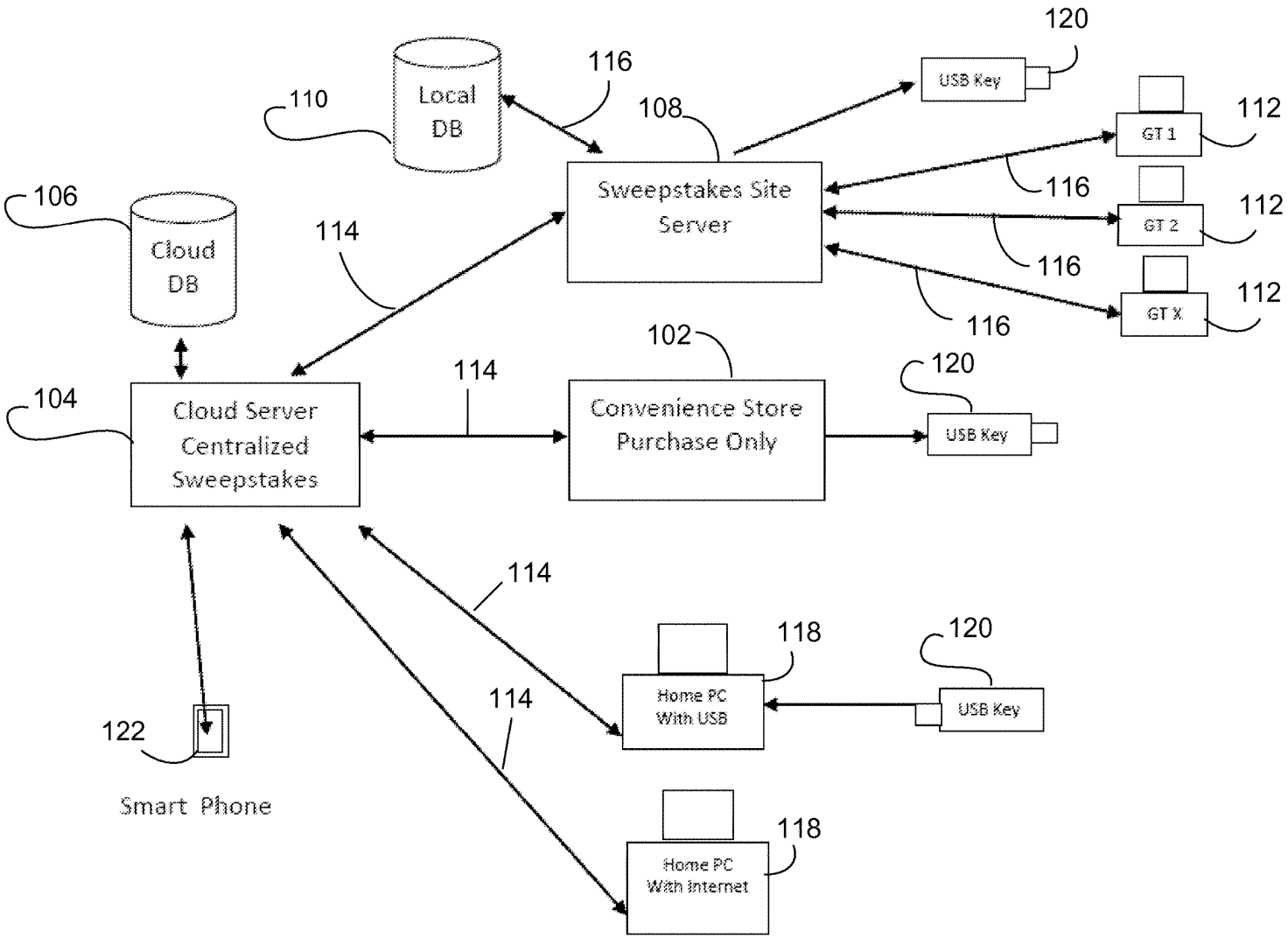
FIG. 1 is block diagram of an exemplary system in accordance with an embodiment of the present system.

Repeated use of reference characters in the present specification and drawings is intended to represent same or analogous features of elements of the invention.

DESCRIPTION OF VARIOUS EMBODIMENTS

Reference will now be made in detail to embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

While reference herein is primarily directed to sweepstakes applications, embodiments of the present invention support electronic sweepstakes, skill-based games, electronic bingo games, casino games, and games structured for all gaming styles known in the art. Embodiments of the invention are agnostic to the methods in which the results are delivered.

In various embodiments, the present systems and methods can be used in connection with electronic sweepstakes games. Generally speaking, electronic sweepstakes, also known as electronic game promotions, operate in brick-and-mortar locations where a customer purchases a long-distance calling card, Internet time, business center services, a rebate coupon, or other products or services. In conjunction, the customer receives a number of sweepstakes entries or game promotion entries.

In various embodiments, at the time of purchase, a central computer server randomly selects one or more sweepstakes entries for the customer from a predetermined, finite pool of entries. In other embodiments, the sweepstakes tickets are randomly selected by the server when the customer accesses a computer terminal and directs the machine to do so. The sweepstakes entries are then assigned to a account associated with that customer. After purchase, the customer may be provided with a receipt, an electronic or magnetic card, or a ticket that contains or displays a personal identification number ("PIN") or other code associated to the customer's account. In various embodiments, the customer may use that PIN, card, or ticket to access the Internet, redeem rebates, utilize business center services, and/or display his sweepstakes entries. Logistically speaking, a customer would typically approach a computer terminal, swipe his card or input his PIN, and be logged into the system.

If the customer elects to display his sweepstakes entries, he may have the option to display the sweepstakes results all at once or utilize an entertaining display to reveal the results one by one. In some operations, the entertaining display may be designed to mimic slot machine reels, a bingo game, a keno game, a poker game, or a similar casino-style game. The games are considered "simulated games" because the games themselves have no impact on the outcome of the sweepstakes. The sweepstakes entries received by the customer are already predetermined as winners or losers—the customer merely uses the game as an entertaining way to reveal that result.

In various embodiments, the software program that runs the sweepstakes creates a finite set of sweepstakes entries and a finite set of prizes. The value of all prizes is predetermined and assigned to a specific sweepstakes entry before the sweepstakes begins. No function of the software or action by the customer can change the content of any sweepstakes entry once it has been created and assigned a prize. The software program randomly selects the sweepstakes entries to be distributed each time a customer initiates a purchase. The electronic sweepstakes does not require a purchase and has an alternate "no purchase necessary" method of entry which has the same odds of winning as the purchase-based entries, as they are all randomly drawn from the same pool of sweepstakes tickets.

Overview

In various embodiments, a system and method allows a customer to receive one or more sweepstakes entries, which are systematically revealed before providing the customer with a ticket, receipt, card, flash drive, or PIN. The system generates a results file containing those results associated with the received entries, which is provided to the customer in the form of a ticket, receipt, card, flash drive, or PIN. That is, rather than providing a customer with an account or card that contains unrevealed sweepstakes entries and allowing customer to electronically reveal his sweepstakes results, the system and method provides a customer with an electronic account, flash drive, or card that contains revealed sweepstakes results. That is, while the customer does not know the result of the selected sweepstakes entries, the system determines the associated result of each entry selected for the customer and allocates the result to the customer's account, drive, or card. The customer may utilize a computer terminal to display those results, but the sweepstakes entry itself has already been revealed before the customer accesses the results.

With regard to the software program, upon a issuance of the sweepstakes tickets, the software may be configured to select a number of sweepstakes entries, reveal each result immediately without notifying the customer of the results, and create a results file to be provided to the customer. The customer's account will already be credited with any prizes from the sweepstakes before the customer even receives the card, flash drive, PIN or results file.

Exemplary Technical Platforms

As will be appreciated by one skilled in the relevant field, the present invention may be, for example, embodied as a computer system, a method, or a computer program product. Accordingly, various embodiments may be entirely hardware or a combination of hardware and software. Furthermore, particular embodiments may take the form of a computer program product stored on a computer-readable storage medium having computer-readable instructions (e.g., software) embodied in the storage medium. Various embodiments may also take the form of web-implemented computer software. Any suitable computer-readable storage medium may be utilized including, for example, hard disks, compact disks, DVDs, optical storage devices, and/or magnetic storage devices.

Various embodiments are described below with reference to block diagrams and flowchart illustrations of methods, apparatuses (e.g., systems), and computer program products. It should be understood that each block of the block diagrams and flowchart illustrations, and combinations of blocks in the block diagrams and flowchart illustrations, respectively, can be implemented by a computer executing computer program instructions. These computer program instructions may be loaded onto a general purpose computer, a special purpose computer, or other programmable data processing apparatus to produce a machine. As such, the instructions which execute on the general purpose computer, special purpose computer, or other programmable data processing apparatus create a system for implementing the functions specified in the flowchart block or blocks. The program code may execute entirely on the customer's computer, partly on the customer's computer, as a stand-alone software package, partly on the customer's computer and partly on a remote computer, or entirely on the remote computer or server. In the latter scenario, the remote computer may be connected to the customer's computer through any type of network, including: a local area network (LAN); a wide area network (WAN); or the connection may be made to an external computer (for example, through the Internet using an Internet Service Provider).

These computer program instructions may also be stored in a computer-readable memory that can direct a computer or other programmable data processing apparatus to function in a particular manner such that the instructions stored in the computer-readable memory produce an article of manufacture that is configured for implementing the function specified in the flowchart block or blocks. The computer program instructions may also be loaded onto a computer or other programmable data processing apparatus to cause a series of operational steps to be performed on the computer, or other programmable apparatus, to produce a computer implemented process. The computer program instructions that that are loaded on the computer or other programmable apparatus execute to provide steps for implementing the functions specified in the flowchart block or blocks.

Accordingly, blocks of the block diagrams and flowchart illustrations support combinations of mechanisms for performing the specified functions, combinations of steps for performing the specified functions, and program instructions for performing the specified functions. It should also be understood that each block of the block diagrams and flowchart illustrations, and combinations of blocks in the block diagrams and flowchart illustrations, can be implemented by special purpose hardware-based computer systems that perform the specified functions or steps, or combinations of special purpose hardware and other hardware executing appropriate computer instructions.

Exemplary System

FIG. 1 illustrates a system 100 for providing a sweepstakes in accordance with an embodiment of the present invention. The system 100 comprises one or more of a kiosk, computer or terminal (generally referred to herein as a kiosk) 102, a cloud based centralized sweepstakes server 104 coupled to a cloud based database 106, a sweepstakes site server 108 coupled to a local database 110, and one or more terminals 112 (that may be any computing based machine) that are operatively coupled to the sweepstakes site server. Those skilled in the art with reference to this disclosure should appreciate that other configurations may be used to accomplish the methods described herein without departing from the scope of the present invention. For example, in various embodiments, the sweepstakes site server 108 may be configured to also provide the functionality provided by the cloud based centralized sweepstakes server 104, or vice-versa.

The kiosk 102 may be a freestanding terminal in a store, which can be used to purchase products, receive sweepstakes entries, and/or display the results of the pre-revealed sweepstakes entries. The kiosk 102 may comprise a display and an input device. The input device may be any device that allows a customer of the terminal to provide instructions to the terminal, such as a keyboard, a numeric pad, a touchpad, a touch matrix, a set of soft keys, a mouse, or a trackball. In an embodiment, the functions of input and display are combined, and the components are replaced with a touch screen.

In various embodiments, the kiosk 102 may comprise a payment terminal that allows the terminal to receive payment information. The payment terminal may include a card reader to read payment and account information from debit and credit cards. The payment terminal may also comprise a cash acceptor for receiving cash including dollar bills and change. The payment terminal may also comprise a receipt dispenser to provide a customer with a receipt for his/her purchase. The construction and operation of payment terminals and cash acceptors and dispensers should be understood by those of ordinary skill in the art and are therefore not described in further detail.

In some embodiments, the kiosk 102 is designed to allow customers to purchase Internet time, rebate coupons, phone cards, or other products/services. In these embodiments, a customer may approach the kiosk, computer, or terminal 102, input a method of payment, and purchase the desired amount of products/services. The kiosk 102 may then provide the customer with a receipt. The kiosk 102 may allow the customer to access the Internet, redeem coupons, display sweepstakes results, or utilize other services.

In various embodiments, the sweepstakes site server 108 may provide the functionality of a point-of-sale (POS) terminal. In these embodiments, a customer may purchase a desired amount of Internet time, rebate coupons, phone cards, or other products/services from a human cashier at the POS terminal. In these embodiment, the human cashier may provide the customer with a receipt that contains a serial number or code, card, flash drive, or other device that may be used to access the Internet, redeem coupons, or utilize other services in the location. The customer may then use the kiosk 102 to access the Internet, redeem coupons, display sweepstakes results, or utilize other services.

One or more of the devices illustrated in FIG. 1 may be connected to a network 114 as previously mentioned. In one embodiment, all devices in FIG. 1 are connected to the network and communicate with each other over the network. It should be noted that the network in FIG. 1 need not be a single network (such as only the internet) and may be multiple networks (whether connected to each other or not). In another embodiment, the network may be a local area network ("LAN") 116 and a wide area network ("WAN") (e.g., the internet) such that one or more devices (for example, the sweepstakes site server 108, database 110 and terminals 112) are connected together via the LAN 116, and the LAN 116 is connected to the WAN 114, which in turn is connected to other devices (for example, one or more personal computers 118 and/or a handheld computing device 122 (e.g., a smartphone or laptop). The terms "linked together" or "connected together" refers to devices having a common network connection via a network (either directly on a network or indirectly through multiple networks), such as one or more devices on the same LAN, WAN or some network combination thereof.

It should be understood that FIG. 1 is an exemplary embodiment of the present system and various other configurations are within the scope of the present system. Additionally, it should be understood that additional devices may be included in the system shown in FIG. 1, or in other embodiments, certain devices may perform the operation of other devices shown in the figure.

Figure 2:
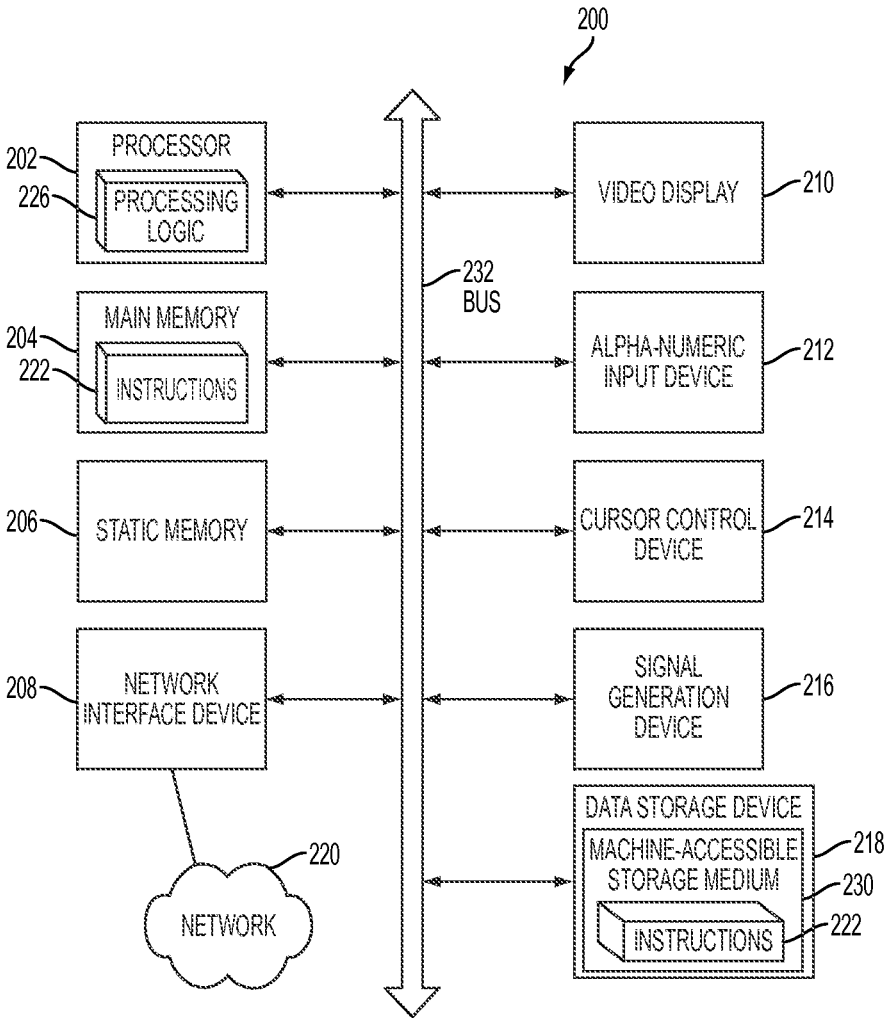
FIG. 2 is a block diagram of a computer that may be used, for example, as a terminal or server computer within the context of system of FIG. 1.

FIG. 2 illustrates a diagrammatic representation of a computer architecture 200 that can be used within the system 100, for example, as a computer (e.g., the kiosk, computer, or terminal 102 shown in FIG. 1), or as a server computer (e.g., the sweepstakes site server 108 shown in FIG. 1). For purposes of this disclosure, reference to a server or processor, should be interpreted to include: a single server, a single processor; multiple servers; multiple processors; or any combination of servers and processors. Moreover, for purposes of this disclosure, the terms "a processor", "at least one processor", "one or more processors" or any other variation should each be interpreted to mean a single processor, one machine having one or more processors, multiple machines having one or more processors, a single server having a single processor, a single server having multiple processors, or multiple servers each having one or more processors.

In particular embodiments, the computer implemented by architecture 200 may be connected (e.g., networked) to other computers by a LAN, an intranet, an extranet, and/or the Internet. The computer may operate in the capacity of a server or a client computer in a client-server network environment, or as a peer computer in a peer-to-peer (or distributed) network environment. The computer may be a personal computer (PC) 118, the handheld computing device 122, a set-top box (STB), a web appliance, a server 104, 108, the kiosk 102, a network router, a switch or bridge, or any computer capable of executing a set of instructions (sequential or otherwise) that specify actions to be taken by that computer. Further, while only a single computer is illustrated, the term "computer" or "processor" may also include any collection of computers that individually or jointly execute a set (or multiple sets) of instructions to perform any one or more of the methodologies discussed herein.

The exemplary computer architecture 200 includes a processor 202, a main memory 204 (e.g., read-only memory (ROM), flash memory, dynamic random access memory (DRAM) such as synchronous DRAM (SDRAM) or Rambus DRAM (RDRAM), etc.), a static memory 206 (e.g., flash memory, static random access memory (SRAM), etc.), and a data storage device 218, which communicate with each other via a bus 232.

The processor 202 represents one or more general-purpose processing devices such as a microprocessor, a central processing unit, or the like. More particularly, the processing device may be a complex instruction set computing (CISC) microprocessor, reduced instruction set computing (RISC) microprocessor, very long instruction word (VLIW) microprocessor, a processor implementing other instruction sets, or processors implementing a combination of instruction sets. The processor 202 may also be one or more special-purpose processing devices such as an application specific integrated circuit (ASIC), a field programmable gate array (FPGA), a digital signal processor (DSP), a network processor, or the like. The processor 202 may be configured to execute the processing logic 226 for performing various operations and steps discussed herein.

The computer architecture 200 may further include a network interface device 208. The computer architecture 200 also may include a video display 210 (e.g., a liquid crystal display (LCD) or a cathode ray tube (CRT)), an alphanumeric input device 212 (e.g., a keyboard), a cursor control device 214 (e.g., a mouse), and a signal generation device 216 (e.g., a speaker).

The data storage device 218 may include a machine accessible storage medium 230 (also known as a non-transitory computer-accessible storage medium, a non-transitory computer-readable storage medium, or a non-transitory computer-readable medium) on which is stored one or more sets of instructions embodying any one or more of the methodologies or functions described herein (e.g., a sweepstakes module 300 or a skill based game module 400). The modules 300,400 may also reside, completely or at least partially, within the main memory 204 and/or within the processor 202 during execution thereof by the computer 200. The main memory 204 and the processor 202 also constitute computer-accessible storage media. The instructions 222 may further be transmitted or received over a network 220 via the network interface device 208.

While the machine-accessible storage medium 230 is shown in an exemplary embodiment to be a single medium, the term "machine-accessible storage medium" should be understood to include a single medium or multiple media (e.g., a centralized or distributed database, and/or associated caches and servers) that store the one or more sets of instructions. The term "machine-accessible storage medium" should also be understood to include any medium that is capable of storing, encoding, or carrying a set of instructions for execution by the computer and that cause the computer to perform any one or more of the methodologies of the present invention. The term "computer-accessible storage medium" should accordingly be understood to include, but not be limited to, solid-state memories, optical, and magnetic media.

Exemplary Methods

Figure 3:
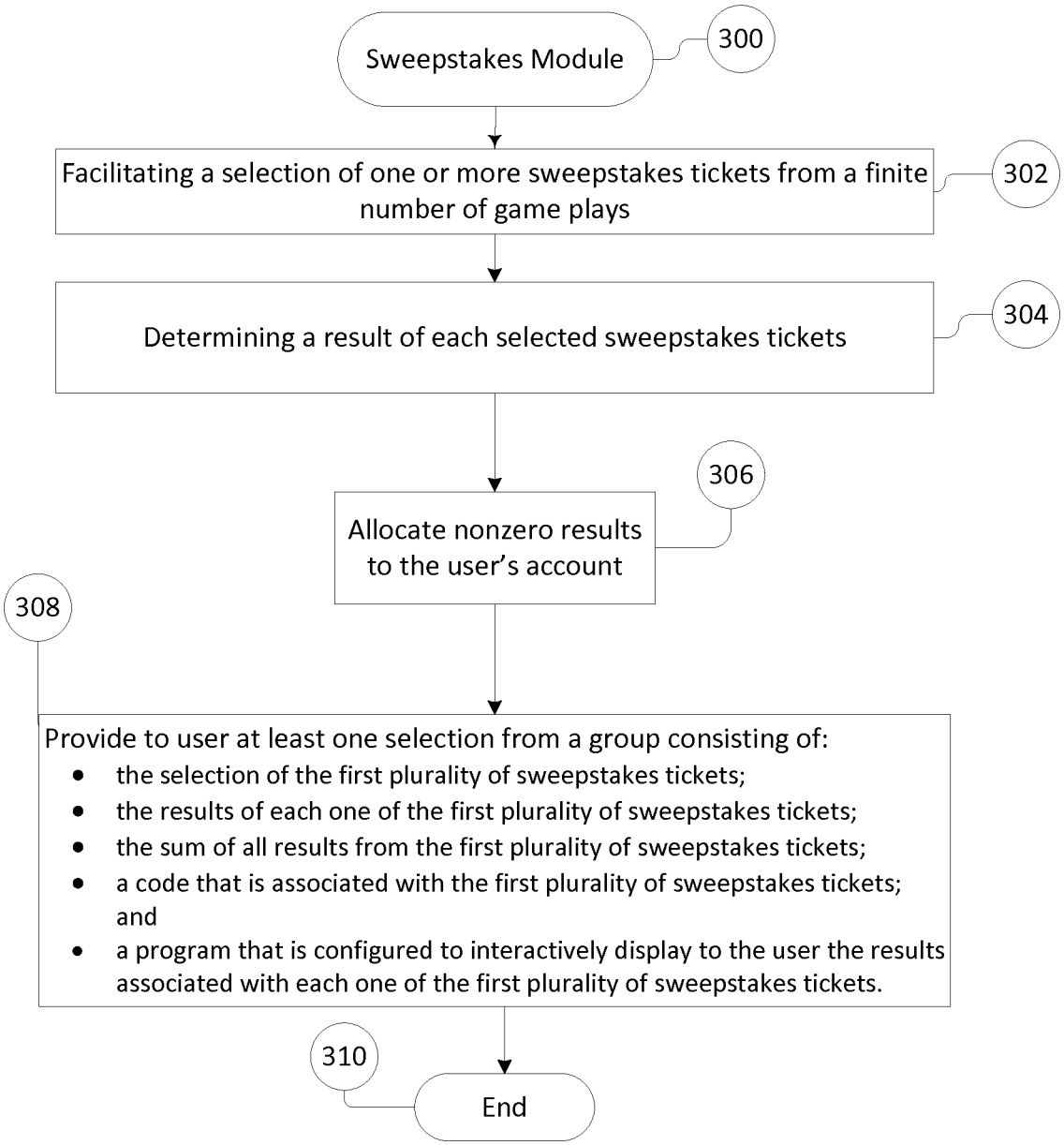
FIG. 3 comprises a flow diagram illustrating an exemplary process performed by the system of FIG. 1 in accordance with an embodiment of the present methods described herein.

FIG. 3 depicts an exemplary method for displaying sweepstakes results. The kiosk, computer or terminal 102, the sweepstakes server 108 and the centralized sweepstakes cloud server 104 may alone, or in combination, perform the method steps described in the module of FIG. 3. It should be understood by reference to this disclosure that these methods describe exemplary embodiments of the method steps carried out by the present system, and that other exemplary embodiments may be created by adding other steps or by removing one or more of the methods steps described in FIG. 3.

The sweepstakes module 300 of FIG. 3 allows a customer to obtain sweepstakes entries and to view the results of the entries either in a brick and mortar establishment, on a handheld computing device, on a home computer, or using a webpage on the Internet. The process begins at step 302 where the system facilitates a selection of one or more sweepstakes tickets from a finite number of sweepstakes tickets. In particular, a customer may purchase Internet time, rebate coupons, phone cards, or other products/services at the kiosk 102 or from a cashier that interfaces with the sweepstakes site server 108. In these embodiments, a customer may purchase the desired amount of products/services and receive one or more sweepstakes entries. For example, based on the amount of the purchase, the customer may receive a corresponding number of sweepstakes entries that are selected from a finite number of sweepstakes entries that are generated by the system 100. Alternatively, the sweepstakes entries may be given away freely.

At step 304, the system determines a result of each one of the selected sweepstakes entries prior to providing the results to the consumer. At step 306, the system 100 allocates all nonzero results from the selected sweepstakes entries to the customer's account.

Once the non-zero results are allocated to the customer's account, at step 308, the system provides the customer at least one of (1) a receipt with a code that is associated with the selected sweepstakes entries, or (2) results from the selected sweepstakes entries, (3) the sum of all results from the selected sweepstakes entries, and (4) a program that is configured to interactively display to the customer the results associated with each one of the selected sweepstakes entries.

Figure 4:
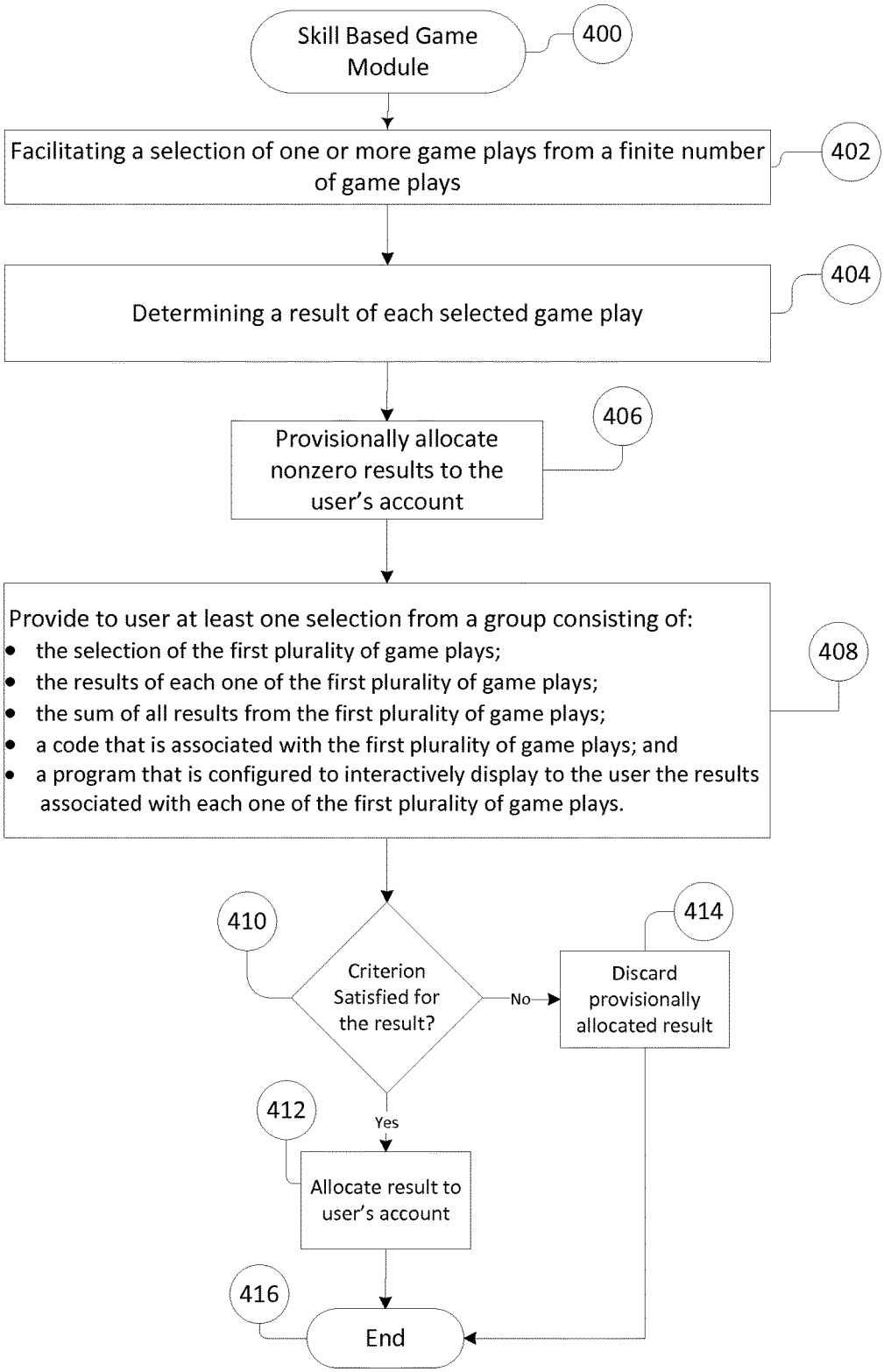
FIG. 4 comprises a flow diagram illustrating another exemplary process performed by the system of FIG. 1 in accordance with an embodiment of the present methods described herein.

While reference herein has primarily been to a sweepstakes, it should be understood that the system and methods have varied applicability. For example, the present system and methods may be applicable to skill based games, which may or may not be selected from a finite pool of games. However, for purposes of example and for ease of example, FIG. 4 is directed to a skill-based game that is based on a sweepstakes game. In skill-based sweepstakes games, the process begins at step 402 where the system facilitates a selection of one or more game plays. At step 404, the system determines a result of each selected game play. At step 406, the system may provisionally allocate all nonzero results for the one or more selected game plays to the customer's account.

Once the non-zero results are allocated to the customer's account, at step 408, the system 100 provides the customer at least one of (1) a receipt with a code that is associated with the selected game plays, (2) results from the selected game plays, (3) the sum of all results from the selected game plays, and (4) a program that is configured to interactively display to the customer the results associated with each one of the selected game plays.

At step 410, the system 100 checks to see if the customer satisfied at least one predetermined criterion. That is, as the customer reveals the result for each entry, the skill-based game play may require the customer to satisfy a predetermined criterion that causes the system to convert the provisionally allocated prize result to a fully allocated prize result. In these embodiments, although a sweepstakes entry has a predetermined prize result associated with the entry prior to the entry being selected for the customer, in order for the customer to receive the prize result, the customer must satisfy at least one criterion. For example, in one embodiment, display of the sweepstakes results may be in the form of a Simon Says game. Thus, if the ticket is assigned a non-zero prize result, the program may require the customer to repeat a light sequence pattern in order to convert the provisionally allocated prize result into a fully allocated prize result. If the customer satisfies the at least one criterion, at step 412, the system 100 converts the provisionally allocated prize result to a fully allocated prize result. If, instead, the customer fails to repeat the light sequence pattern, the provisionally allocated prize result may be discarded from the customer's account, at step 414.

In various embodiments, if the customer is provided with a receipt that contains a PIN or code, the customer may display the results using the kiosk 102 at the place of purchase, leave the brick-and-mortar location and use the PIN or code to access his customer account from the personal computer 118 or view the results on his handheld computing device 122. The customer could then download software onto his personal computer 118 or handheld device 122 that allows him to display the sweepstakes results in an entertaining manner. Alternatively, the customer could utilize a live stream of a simulated casino-game that allows him to display the sweepstakes results. Once the customer views the sweepstakes results, he could return to the location from which he obtained the sweepstakes entries and collect any prizes won.

In various embodiments, instead of providing the customer with a receipt containing a code or other type of identifier (e.g., a barcode) that is associated with the results for the selected sweepstakes entries, the customer could have the sweepstakes results file placed on a handheld storage device 120 such as an optical disk storage (e.g., CD or DVD), a solid state drive ("SSD"), a magnetic disk storage (e.g., a floppy or hard drives), any type of non-volatile memory (e.g., a secure digital, flash memory, USB key, memory stick) or any other medium that may be used to carry or store computer program code in the form of computer-executable programs, instructions, or data.

The sweepstakes results file may be accompanied by files or data that allow the customer to display the results in an entertaining manner, such as through the use of a simulated casino game. The customer may elect, at the time of purchase, a particular game theme or format for his entertaining display of results. In various embodiments, the customer could take the sweepstakes results contained on the handheld storage device 120 and display the entertaining results at home on the personal computer 118, if so desired. No software would need to be downloaded to the personal computer 118 because the entertaining display would play directly from the handheld storage device 120. In various embodiments where each of the selected plays is included on the handheld storage device, the program would display a result associated with the play when the customer selects a play button (e.g., a spin button on a user interface). In other embodiments where the handheld storage device contains a sum of the total results, the program may be configured to play the game until the total results sum has been distributed to the consumer. That is, the software would not be constrained to the selected number of plays to distribute the total sum of the results and may do so in any number of plays. Once the customer concludes the display of the sweepstakes results, they can return the handheld storage device 120 to the location in which it was loaded with the results file and collect any prizes won.

In yet other embodiments, a customer could have the sweepstakes results deposited to their account, which can then be accessed from the handheld computing device 122, such as a cellphone, tablet or other mobile device. In these embodiments, a customer could download an application from an application store to the handheld computing device 122 that would permit the display of the sweepstakes results in an entertaining manner. Once the customer concludes the display of the sweepstakes results, they can return to the location from which he obtained the sweepstakes entries and collect any prizes won.

In any of the above embodiments where the results associated with the selected entries is provided to the customer on a handheld storage device, in various embodiments, the data provided to the customer is for display purposes and will not affect the results allocated to the customer's account. That is, if the customer attempted to hack the results file, the hacked results file could not change the prize amounts allocated to the customer's account since the results associated with the selected sweepstakes entries were previously determined and allocated to the customer's account prior to the customer received the handheld storage device.

In alternate embodiments, the Internet time, rebate coupons, or other products can be purchased directly from the personal computer 118 or handheld computing device 122 and the customer need not enter a brick-and-mortar Internet café in order to purchase such products. In some of these embodiments, the present system and method allows the customer to use any prize results to purchase various products. In these embodiments, a customer has his sweepstakes results allocated to his customer account. The customer can then display the sweepstakes results in an entertaining manner through a home computer or mobile device. If the customer has won any prizes, he may then use the personal computer 118 or the handheld computing device 122 to use those prizes to purchase products such as Internet time, rebate coupons, or other products. The purchase of these products, in some embodiments, provides the customer with additional free sweepstakes entries that are pre-revealed and placed into the customer's account as a results file as described above. This process can be repeated as desired by the customer.

In certain embodiments described above, the allocated sweepstakes results are allocated to the customer's account in a manner that allows the customer to view the results without an entertaining display used to view the results. That is, the customer can log into their account and view the amount won from the sweepstakes entries without displaying the results through a game format. In other embodiments, although the prize amounts are allocated to the customer's account, the amounts won are not viewable to the customer until the customer interactively displays the results using one of the methods described above.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in the art that the present invention is not limited to these embodiments. Therefore, it is contemplated that any and all such embodiments are included in the present invention as may fall within the scope and spirit thereof.

What is claimed:

1. A method of providing a sweepstakes prize, the method comprising:

a. facilitating, by one or more processors, selection of a first plurality of sweepstakes tickets from a second finite plurality of sweepstakes tickets in response to a request from a user;

b. prior to a visual display of the results of the first plurality of tickets to a user account, determining, by the one or more processors, a prize associated with each of the first plurality of sweepstakes tickets and a total value for the prizes associated with the first plurality of sweepstakes tickets;

c. prior to a visual display of the results of the first plurality of tickets to a user account, crediting to an account for the user, by the one or more processors, the total prize value associated with the first plurality of sweepstakes tickets; and d. providing to the user a visual display of the results of the first plurality of sweepstakes tickets.

2. The method of claim 1, further comprising generating, by the one or more processors, the second plurality of sweepstakes tickets prior to the start of the sweepstakes.

3. The method of claim 1, further comprising displaying the prize for each one of the first plurality of sweepstakes tickets prior to a visual display of the results of the first plurality of tickets.

4. The method of claim 1, wherein the visual display of the results of the first plurality of sweepstakes tickets is provided on a handheld storage device.

5. The method of claim 4, wherein the handheld storage device is flash memory.

6. The method of claim 5, wherein computer code that is configured to display to the user the results associated with each one of the first plurality of sweepstakes tickets is provided on the flash memory.

7. The method of claim 6, wherein the computer code is configured to be accessible over a network.

8. The method of claim 6, wherein the computer code is configured to be downloaded to a handheld portable device.

9. The method of claim 1, wherein the program is configured to interactively display the results in a form selected from a group consisting of:

a. a bingo game;

b. a slot machine game; and c. a skill based game.

10. A method of providing a sweepstakes prize comprising:

a. facilitating, by one or more processors, selection of a plurality of game plays;

b. prior to a visual display of the results of the game plays, determining, by the one or more processors, the prize associated with each one of the plurality of game plays and a total value for the prizes associated with the first plurality of game plays;

c. prior to a visual display of the results of the game plays, provisionally crediting the total value for the prizes associated with the first plurality of game plays to the user; and d. providing to the user at least one selection from a group consisting of:

i. a visual display of the plurality of game plays;

ii. a code that is associated with the plurality of game plays; and iii. a program that is configured to cause a computer to interactively display to the user the results associated with the plurality of game plays.

11. The method of claim 10, wherein the step of provisionally crediting the total value for the prizes to the user further comprises crediting an account of the user for each nonzero prize.

12. The method of claim 11, wherein the credit for at least one nonzero prize is dependent on the user satisfying at least one criterion.

13. The method of claim 10, wherein the step of facilitating the selection further comprises selecting the plurality of game plays in response to a request from the user to purchase an item.

14. The method of claim 10, wherein the step of providing the result of each one of the plurality of game plays further comprises immediately notifying the user of the amount of each prize.

15. The method of claim 10, further comprising providing a terminal that is configured to allow the user to display the results of the selected game plays that were previously provided to the user.

16. The method of claim 10, further comprising a selection from a group consisting of:

a. releasing at least one prize of the provisionally credited total value for the prizes for a particular game play from the first plurality of game plays if the user satisfies a first criterion;

b. discarding at least one prize of the provisionally credited total value for the prizes for the particular game play if the user does not satisfy the first criterion.

17. The method of claim 10, wherein the each one of the plurality of game plays is a sweepstakes entry.

18. A terminal comprising:

a. one or more processors;

b. memory operatively coupled to the one or more processors; and c. a display operatively coupled to the one or more processors, wherein the one or more processors are configured to:

i. facilitate the selection of at least one sweepstakes ticket from a plurality of sweepstakes tickets;

ii. determine the prize associated with each of the at least one sweepstakes tickets and the total prize value of all of the at least one selected sweepstakes tickets;

iii. credit the total prize value of all of the at least one selected sweepstakes tickets to a user account; and iv. perform at least one step selected from a group consisting of:

1) providing the user with a file that contains the results of the at least one sweepstakes ticket on a handheld storage device;

2) providing the user with a code associated with the results of the at least one sweepstakes ticket; and 3) providing the user with program code in the form of computer executable instructions on the handheld storage device, wherein the program code is configured to read the file and display the results of the at least one sweepstakes ticket to the user.

19. The terminal of claim 18, wherein the one or more processors is operatively coupled to one or more servers by a network.

20. The terminal of claim 19, wherein facilitating the selection of the at least one sweepstakes ticket further comprises selecting, by at least one server, the at least one sweepstakes ticket from the plurality of sweepstakes tickets.

21. The terminal of claim 18, wherein the one or more processors is further configured to:

a. receive a request to purchase an item;

b. receive payment for the purchased item;

wherein the number of selected sweepstakes entries is at least partially based on the purchased item.

* * * * *